US011382189B2

(12) United States Patent
Di Martino et al.

(10) Patent No.: US 11,382,189 B2
(45) Date of Patent: Jul. 5, 2022

(54) METHOD OF DIAGNOSING AN ELECTROMAGNETIC COOKING DEVICE

(71) Applicants: WHIRLPOOL CORPORATION, Benton Harbor, MI (US); Panasonic Corporation, Osaka (JP)

(72) Inventors: Roberto Di Martino, Varese (IT); Giovanni Dore, Arezzo (IT); Francesco Giordano, Cremona (IT)

(73) Assignees: Whirlpool Corporation, Benton Harbor, MI (US); Panasonic Holdings Corporation

( * ) Notice: Subject to any disclaimer, the term of this patent is extended or adjusted under 35 U.S.C. 154(b) by 205 days.

(21) Appl. No.: 16/308,906

(22) PCT Filed: Dec. 23, 2016

(86) PCT No.: PCT/US2016/068489

§ 371 (c)(1),
(2) Date: Dec. 11, 2018

(87) PCT Pub. No.: WO2018/118077

PCT Pub. Date: Jun. 28, 2018

(65) Prior Publication Data

US 2019/0306935 A1 Oct. 3, 2019

(51) Int. Cl.

| | |
|---|---|
| ***H05B 6/70*** | (2006.01) |
| ***H05B 6/68*** | (2006.01) |
| ***H05B 6/72*** | (2006.01) |

(52) U.S. Cl.

CPC ..... *H05B 6/705* (2013.01); *H05B 6/681* (2013.01); *H05B 6/686* (2013.01); *H05B 6/70* (2013.01); *H05B 6/72* (2013.01)

(58) Field of Classification Search

CPC ..... H05B 6/681; H05B 6/686; H05B 6/70; H05B 6/705; H05B 6/72; Y02B 40/146

USPC ..... 219/747, 761, 716, 709, 746, 748, 750, 219/702, 756, 697; 439/576

See application file for complete search history.

(56) References Cited

U.S. PATENT DOCUMENTS

| | | | |
|---|---|---|---|
| 4,196,332 | A | 4/1980 | MacKay B et al. |
| 5,521,360 | A | 5/1996 | Johnson et al. |
| 6,097,019 | A | 8/2000 | Lewis et al. |

(Continued)

FOREIGN PATENT DOCUMENTS

| | | | |
|---|---|---|---|
| EP | 2200402 | A1 | 6/2010 |
| EP | 2528415 | A2 | 11/2012 |

(Continued)

*Primary Examiner* — Quang T Van

(74) *Attorney, Agent, or Firm* — Price Heneveld LLP

(57) ABSTRACT

A method for diagnosing an electromagnetic cooking device includes selecting a frequency from a set of frequencies in a bandwidth of radio frequency electromagnetic waves; setting a subset of a set of radio frequency feeds to output a radio frequency signal of the selected frequency; measuring a forward power level for the subset of the set of radio frequency feeds that is outputting the radio frequency signal; measuring a forward and backward power level for the set of radio frequency feeds; and processing the measurements of the forward and backward power levels to determine an operating condition of the electromagnetic cooking device based on the processing of the measurements of the forward and backward power levels.

22 Claims, 4 Drawing Sheets

(56) References Cited

U.S. PATENT DOCUMENTS

| | | | | |
|---|---|---|---|---|
| 8,287,527 | B2 | 10/2012 | Brannan et al. | |
| 8,324,540 | B2 | 12/2012 | Nordh et al. | |
| 8,330,085 | B2 | 12/2012 | Ishizaki et al. | |
| 8,389,916 | B2 | 3/2013 | Ben-Shmuel et al. | |
| 2009/0236333 | A1 | 9/2009 | Ben Shmuel et al. | |
| 2009/0236334 | A1 | 9/2009 | Ben-Shmuel et al. | |
| 2009/0236335 | A1 | 9/2009 | Ben-Shmuel et al. | |
| 2010/0115785 | A1 | 5/2010 | Ben-Shmuel et al. | |
| 2010/0121318 | A1 | 5/2010 | Hancock et al. | |
| 2010/0176121 | A1 | 7/2010 | Nobue et al. | |
| 2010/0176123 | A1* | 7/2010 | Mihara ..... | H05B 6/686 219/746 |
| 2011/0031236 | A1 | 2/2011 | Ben-Shmuel et al. | |
| 2011/0290790 | A1 | 12/2011 | Sim et al. | |
| 2012/0067872 | A1 | 3/2012 | Libman et al. | |
| 2012/0103972 | A1 | 5/2012 | Okajima | |
| 2012/0168645 | A1 | 7/2012 | Atzmony et al. | |
| 2013/0048881 | A1 | 2/2013 | Einziger et al. | |
| 2013/0056460 | A1 | 3/2013 | Ben-Shmuel et al. | |
| 2013/0119054 | A1 | 5/2013 | Ben-Shmuel et al. | |

FOREIGN PATENT DOCUMENTS

| | | | |
|---|---|---|---|
| EP | 2544508 | A2 | 1/2013 |
| JP | 61-27093 | | 2/1986 |
| JP | 4-245191 | | 9/1992 |
| JP | 2008108491 | A | 5/2008 |
| RU | 2008115817 | A | 10/2009 |
| RU | 2253193 | C2 | 2/2012 |
| WO | 2008007368 | A2 | 1/2008 |
| WO | 2008018466 | A1 | 2/2008 |
| WO | 2008102360 | A2 | 8/2008 |
| WO | 2009039521 | A1 | 3/2009 |
| WO | 2011058537 | A1 | 5/2011 |
| WO | 2011058538 | A1 | 5/2011 |
| WO | 2011138675 | A2 | 11/2011 |
| WO | 2011138679 | A2 | 11/2011 |
| WO | 2011138680 | A2 | 11/2011 |
| WO | 2011138688 | A2 | 11/2011 |
| WO | 2012094375 | A1 | 7/2012 |
| WO | 2013021280 | A2 | 2/2013 |
| WO | 2014188422 | A2 | 11/2014 |
| WO | 2016144872 | A1 | 9/2016 |

* cited by examiner

METHOD OF DIAGNOSING AN ELECTROMAGNETIC COOKING DEVICE

BACKGROUND

The present invention generally relates to a method for diagnosing an electromagnetic cooking device, and more specifically, to a method of modeling multiple high power amplifiers of a microwave oven as a multiport radio frequency network to characterize the state of said network.

A conventional microwave oven cooks food by a process of dielectric heating in which a high-frequency alternating electromagnetic field is distributed throughout an enclosed cavity. A sub-band of the radio frequency spectrum, microwave frequencies at or around 2.45 GHz cause dielectric heating primarily by absorption of energy in water.

To generate microwave frequency radiation in a conventional microwave, a voltage applied to a high-voltage transformer results in a high-voltage power that is applied to a magnetron that generates microwave frequency radiation. The microwaves are then transmitted to an enclosed cavity containing the food through a waveguide. Cooking food in an enclosed cavity with a single, non-coherent source like a magnetron can result in non-uniform heating of the food. To more evenly heat food, microwave ovens include, among other things, mechanical solutions such as a microwave stirrer and a turntable for rotating the food. A common magnetron-based microwave source is not narrowband and not tuneable (i.e. emits microwaves at a frequency that is changing over time and not selectable). As an alternative to such a common magnetron-based microwave source, solid-state sources can be included in microwave ovens which are tunable and coherent.

SUMMARY

In one aspect, a method for diagnosing an electromagnetic cooking device, the electromagnetic cooking device comprising a set of radio frequency feeds, each feed comprising an amplifying component configured to output a signal that is amplified in power with respect to an input radio frequency signal and a measuring component that outputs a digital signal indicative of radio frequency power detected at the amplifying component is provided. The method includes selecting a frequency from a set of frequencies in a bandwidth of radio frequency electromagnetic waves; setting a subset of the set of radio frequency feeds to output a radio frequency signal of the selected frequency; measuring a forward power level for the subset of the set of radio frequency feeds that is outputting the radio frequency signal; measuring a backward power level the set of radio frequency feeds; and processing the measurements of the forward and backward power levels to determine an operating condition of the electromagnetic cooking device based on the processing of the measurements of the forward and backward power levels.

In another aspect, an electromagnetic cooking device includes an enclosed cavity; a set of radio frequency feeds in the enclosed cavity configured to heat up and prepare food by introducing electromagnetic radiation into the enclosed cavity; a set of high-power radio frequency amplifiers coupled to the set of radio frequency feeds and a controller configured to diagnose the electromagnetic cooking device. Each high-power amplifier includes an amplifying component configured to output a signal that is amplified in power with respect to an input radio frequency signal and a measuring component configured to output a digital signal indicative of radio frequency power detected at the amplifying component. The controller is configured to diagnose the electromagnetic cooking device by selecting a frequency from a set of frequencies in a bandwidth of radio frequency electromagnetic waves and setting a subset of the set of high-power amplifiers to output a radio frequency signal of the selected frequency. The controller is further configured to receive from the power measuring component: a measurement of a forward power level for the subset of the set of high-power radio frequency amplifiers that is outputting the radio frequency signal; and a measurement of a backward power level for the set of high-power radio frequency amplifiers. The controller is further configured to process the measurements of the forward and backward power levels to determine an operating condition of the electromagnetic cooking device based on the processing of the measurements of the forward and backward power levels.

DETAILED DESCRIPTION

It is to be understood that the specific devices and processes illustrated in the attached drawings, and described in the following specification are simply exemplary embodiments of the inventive concepts defined in the appended claims. Hence, other physical characteristics relating to the embodiments disclosed herein are not to be considered as limiting, unless the claims expressly state otherwise.

A solid-state radio frequency (radio frequency) cooking appliance heats up and prepares food by introducing electromagnetic radiation into an enclosed cavity. Multiple radio frequency feeds at different locations in the enclosed cavity produce dynamic electromagnetic wave patterns as they radiate. To control and shape of the wave patterns in the enclosed cavity, the multiple radio frequency feeds can radiate waves with separately controlled electromagnetic characteristics to maintain coherence (that is, a stationary interference pattern) within the enclosed cavity. For example, each radio frequency feed can transmit a different phase and/or amplitude with respect to the other feeds. Other electromagnetic characteristics can be common among the radio frequency feeds. For example, each radio frequency feed can transmit at a common but variable frequency. Although the following embodiments are directed to a cooking appliance where radio frequency feeds direct electromagnetic radiation to heat an object in an enclosed cavity, it will be understood that the methods described herein and the inventive concepts derived herefrom are not so limited. The covered concepts and methods are applicable to any radio frequency device where electromagnetic radiation is directed to an enclosed cavity to act on an object inside the cavity. Exemplary devices include ovens, dryers, steamers, and the like.

Figure 1:
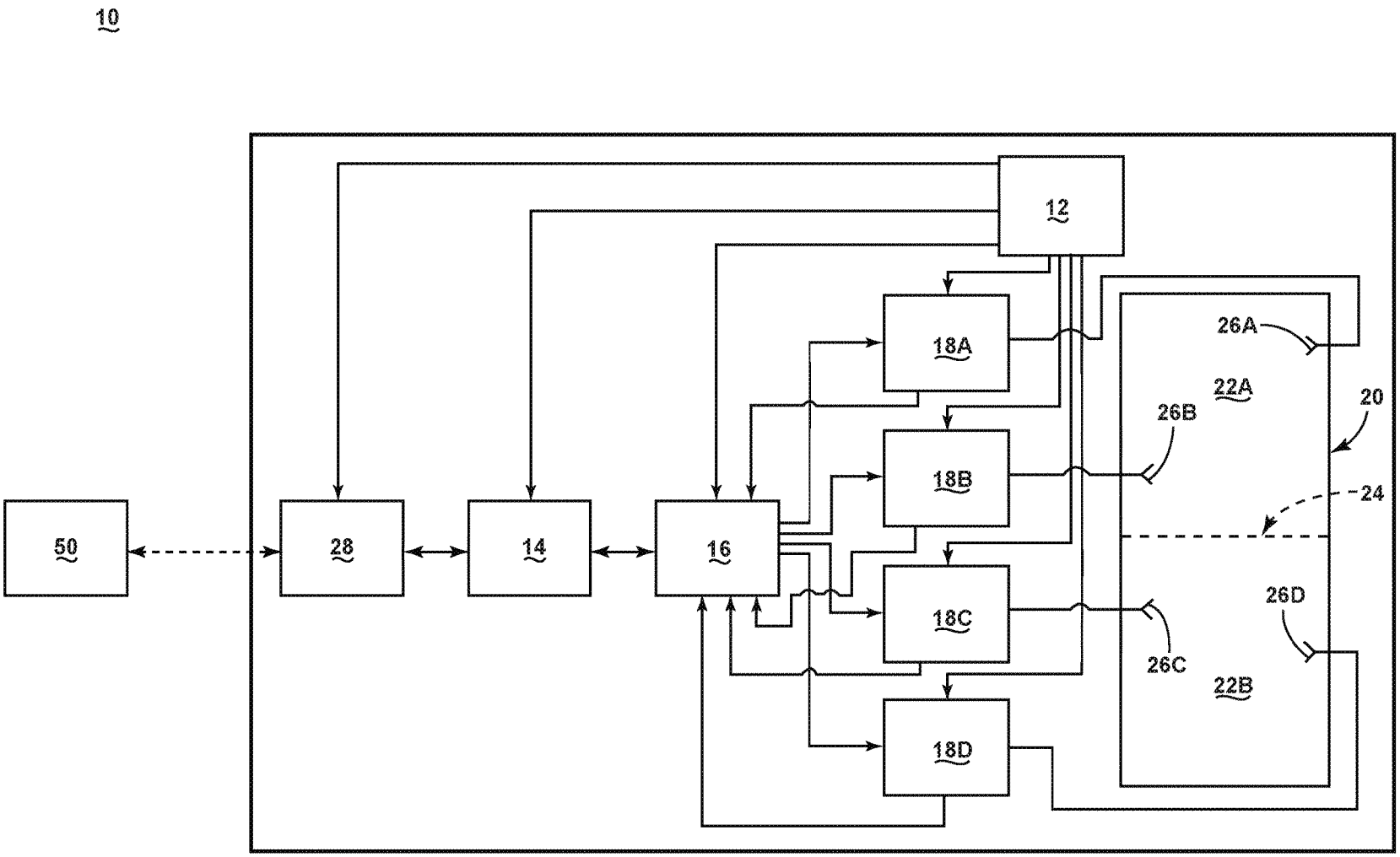
FIG. 1 is a block diagram of an electromagnetic cooking device with multiple coherent radio frequency feeds in accordance with various aspects described herein.

FIG. 1 shows a block diagram of an electromagnetic cooking device 10 with multiple coherent radio frequency feeds 26A-D according to one embodiment. As shown in FIG. 1, the electromagnetic cooking device 10 includes a power supply 12, a controller 14, a radio frequency signal generator 16, a human-machine interface 28 and multiple high-power radio frequency amplifiers 18A-D coupled to the multiple radio frequency feeds 26A-D. The multiple radio frequency feeds 26A-D each couple radio frequency power from one of the multiple high-power radio frequency amplifiers 18A-D into an enclosed cavity 20.

The power supply 12 provides electrical power derived from mains electricity to the controller 14, the radio frequency signal generator 16, the human-machine interface 28 and the multiple high-power radio frequency amplifiers 18A-D. The power supply 12 converts the mains electricity to the required power level of each of the devices it powers. The power supply 12 can deliver a variable output voltage level. For example, the power supply 12 can output a voltage level selectively controlled in 0.5-Volt steps. In this way, the power supply 12 can be configured to typically supply 28 Volts direct current to each of the high-power radio frequency amplifiers 18A-D, but can supply a lower voltage, such as 15 Volts direct current, to decrease an radio frequency output power level by a desired level.

A controller 14 can be included in the electromagnetic cooking device 10, which can be operably coupled with various components of the electromagnetic cooking device 10 to implement a cooking cycle. The controller 14 can also be operably coupled with a control panel or human-machine interface 28 for receiving user-selected inputs and communicating information to a user. The human-machine interface 28 can include operational controls such as dials, lights, switches, touch screen elements, and displays enabling a user to input commands, such as a cooking cycle, to the controller 14 and receive information. The user interface 28 can be one or more elements, which can be centralized or dispersed relative to each other. The controller 14 may also select the voltage level supplied by power supply 12.

The controller 14 can be provided with a memory and a central processing unit (CPU), and can be preferably embodied in a microcontroller. The memory can be used for storing control software that can be executed by the CPU in completing a cooking cycle. For example, the memory can store one or more pre-programmed cooking cycles that can be selected by a user and completed by the electromagnetic cooking device 10. The controller 14 can also receive input from one or more sensors. Non-limiting examples of sensors that can be communicably coupled with the controller 14 include peak level detectors known in the art of radio frequency engineering for measuring radio frequency power levels and temperature sensors for measuring the temperature of the enclosed cavity or one or more of the high-power amplifiers 18A-D.

Based on the user input provided by the human-machine interface 28 and data including the forward and backward (or reflected) power magnitudes coming from the multiple high-power amplifiers 18A-D (represented in FIG. 1 by the path from each of the high-power amplifiers 18A-D through the radio frequency signal generator 16 to the controller 14), the controller 14 can determine the cooking strategy and calculate the settings for the radio frequency signal generator 16. In this way, one of the main functions of the controller 14 is to actuate the electromagnetic cooking device 10 to instantiate the cooking cycle as initiated by the user. The radio frequency signal generator 16 as described below then can generate multiple radio frequency waveforms, that is, one for each high-power amplifier 18A-D based on the settings indicated by the controller 14.

The high-power amplifiers 18A-D, each coupled to one of the radio frequency feeds 26A-D, each output a high power radio frequency signal based on a low power radio frequency signal provided by the radio frequency signal generator 16. The low power radio frequency signal input to each of the high-power amplifiers 18 A-D can be amplified by transforming the direct current electrical power provided by the power supply 12 into a high power radio frequency signal. In one non-limiting example, each high-power amplifier 18A-D can be configured to output an radio frequency signal ranging from 50 to 250 Watts. The maximum output wattage for each high-power amplifier can be more or less than 250 Watts depending upon the implementation.

Additionally, each of the high-power amplifiers 18A-D includes a sensing capability to measure the magnitude of the forward and the backward power levels at the amplifier output. The measured backward power at the output of each high-power amplifier 18A-D indicates a power level returned to the high-power amplifier 18A-D as a result of an impedance mismatch between the high-power amplifier 18A-D and the enclosed cavity 20. Besides providing feedback to the controller 14 and the radio frequency signal generator 16 to implement, in part, a cooking strategy, the backward power level can indicate excess reflected power that can damage the high-power amplifier 18A-D.

Consequently, each high-power amplifier 18A-D can include a dummy load to absorb excessive radio frequency reflections. Along with the determination of the backward power level at each of the high-power amplifiers 18A-D, temperature sensing at the high-power amplifier 18A-D including at the dummy load can provide the data necessary to determine if the backward power level has exceeded a predetermined threshold. If the threshold is exceeded, any of the controlling elements in the radio frequency transmission chain including the power supply 12, controller 14, the radio frequency signal generator 16, or the high-power amplifier 18A-D can determine that the high-power amplifier 18A-D can be switched to a lower power level or completely turned off. For example, each high-power amplifier 18A-D can switch itself off automatically if the backward power level or sensed temperature is too high for several milliseconds. Alternatively, the power supply 12 can cut the direct current power supplied to the high-power amplifier 18A-D.

The multiple radio frequency feeds 26A-D couple power from the multiple high-power radio frequency amplifiers 18A-D to the enclosed cavity 20. The multiple radio frequency feeds 26A-D can be coupled to the enclosed cavity 20 in spatially separated but fixed physical locations. The multiple radio frequency feeds 26A-D can be implemented via waveguide structures designed for low power loss propagation of radio frequency signals. In one non-limiting example, metallic, rectangular waveguides known in microwave engineering are capable of guiding radio frequency power from a high-power amplifier 18A-D to the enclosed cavity 20 with a power attenuation of approximately 0.03 decibels per meter.

The enclosed cavity 20 can selectively include subcavities 22A-B by insertion of an optional divider 24 therein. The enclosed cavity 20 can include, on at least one side, a shielded door to allow user access to the interior of the enclosed cavity 20 for placement and retrieval of food or the optional divider 24.

The transmitted bandwidth of each of the radio frequency feeds 26A-D can include frequencies ranging from 2.4 GHz to 2.5 GHz. The radio frequency feeds 26A-D can be configured to transmit other radio frequency bands. For example, the bandwidth of frequencies between 2.4 GHz and 2.5 GHz is one of several bands that make up the industrial, scientific and medical (ISM) radio bands. The transmission of other radio frequency bands is contemplated and can include non-limiting examples contained in the ISM bands defined by the frequencies: 13.553 MHz to 13.567 MHz, 26.957 MHz to 27.283 MHz, 902 MHz to 928 MHz, 5.725 GHz to 5.875 GHz and 24 GHz to 24.250 GHz.

Figure 2:
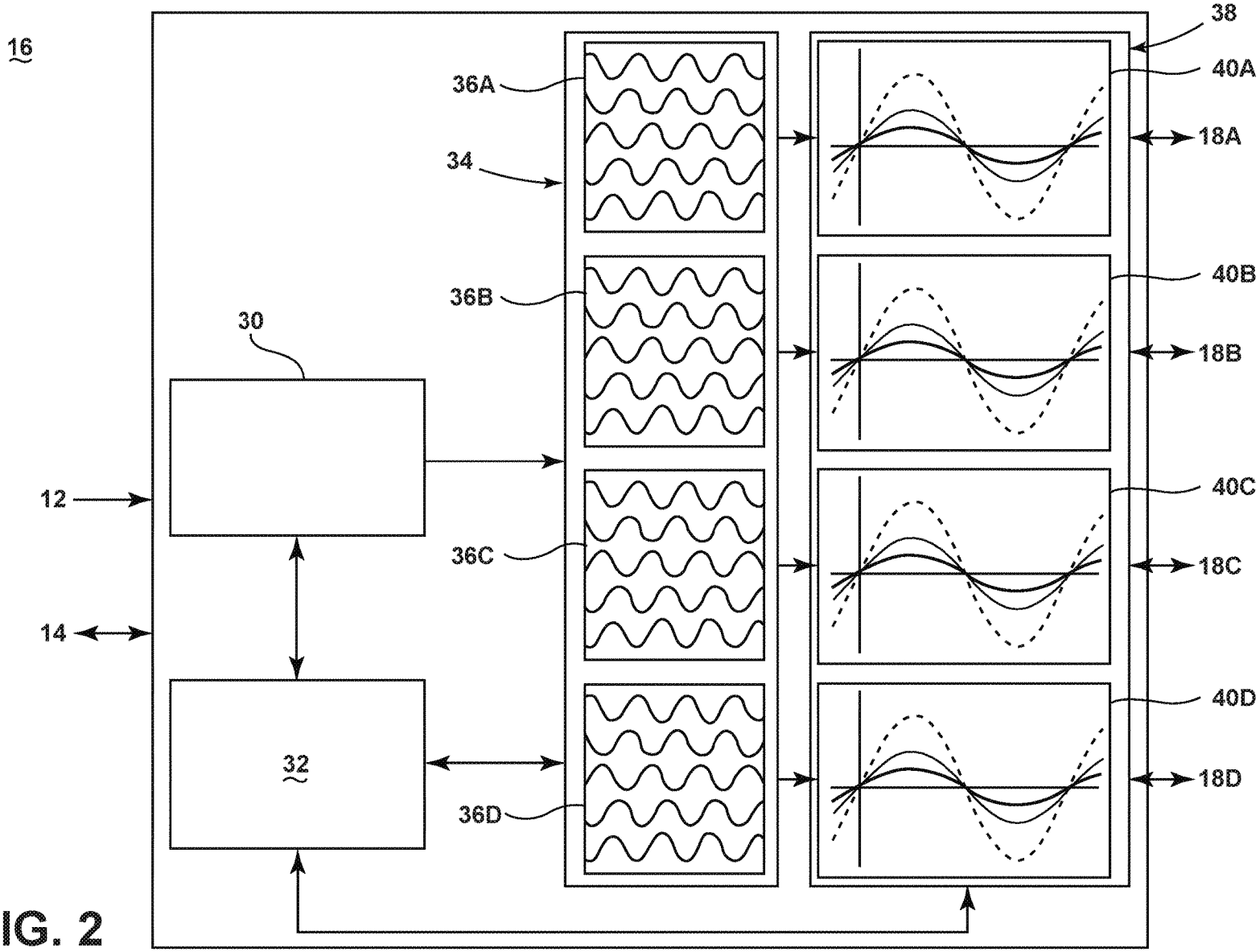
FIG. 2 is a block diagram of a radio frequency signal generator of FIG. 1.

Referring now to FIG. 2, a block diagram of the radio frequency signal generator 16 is shown. The radio frequency signal generator 16 includes a frequency generator 30, a phase generator 34 and an amplitude generator 38 sequentially coupled and all under the direction of an radio frequency controller 32. In this way, the actual frequency, phases and amplitudes to be output from the radio frequency signal generator 16 to the high power amplifiers are programmable through the radio frequency controller 32, preferably implemented as a digital control interface. The radio frequency signal generator 16 can be physically separate from the cooking controller 14 or can be physically mounted onto or integrated into the controller 14. The radio frequency signal generator 16 is preferably implemented as a bespoke integrated circuit.

As shown in FIG. 2 the radio frequency signal generator 16 outputs four radio frequency channels 40A-D that share a common but variable frequency (e.g. ranging from 2.4 GHz to 2.5 GHz), but are settable in phase and amplitude for each radio frequency channel 40A-D. The configuration described herein is exemplary and should not be considered limiting. For example, the radio frequency signal generator 16 can be configured to output more or less channels and can include the capability to output a unique variable frequency for each of the channels depending upon the implementation.

As previously described, the radio frequency signal generator 16 can derive power from the power supply 12 and input one or more control signals from the controller 14. Additional inputs can include the forward and backward power levels determined by the high-power amplifiers 18A-D. Based on these inputs, the radio frequency controller 32 can select a frequency and signal the frequency generator 30 to output a signal indicative of the selected frequency. As represented pictorially in the block representing the frequency generator 30 in FIG. 2, the selected frequency determines a sinusoidal signal whose frequency ranges across a set of discrete frequencies. In one non-limiting example, a selectable bandwidth ranging from 2.4 GHz to 2.5 GHz can be discretized at a resolution of 1 MHz allowing for 101 unique frequency selections.

After the frequency generator 30, the signal is divided per output channel and directed to the phase generator 34. Each channel can be assigned a distinct phase, that is, the initial angle of a sinusoidal function. As represented pictorially in the block representing the per channel phase generator 36A-D in FIG. 2, the selected phase of the radio frequency signal for a channel can range across a set of discrete angles. In one non-limiting example, a selectable phase (wrapped across half a cycle of oscillation or 180 degrees) can be discretized at a resolution of 10 degrees allowing for 19 unique phase selections per channel.

Subsequent to the phase generator 34, the radio frequency signal per channel can be directed to the amplitude generator 38. The radio frequency controller 32 can assign each channel (shown in FIG. 2 with a common frequency and distinct phase) to output a distinct amplitude in the channel 40A-D. As represented pictorially in the block representing the per channel amplitude generator in FIG. 2, the selected amplitude of the radio frequency signal can range across a set of discrete amplitudes (or power levels). In one non-limiting example, a selectable amplitude can be discretized at a resolution of 0.5 decibels across a range of 0 to 23 decibels allowing for 47 unique amplitude selections per channel.

The amplitude of each channel 40A-D can be controlled by one of several methods depending upon the implementation. For example, control of the supply voltage of the amplitude generator 38 for each channel can result in an output amplitude for each channel 40A-D from the radio frequency signal generator 16 that is directly proportional to the desired radio frequency signal output for the respective high-power amplifier 18A-D. Alternatively, the per channel output can be encoded as a pulse-width modulated signal where the amplitude level is encoded by the duty cycle of the pulse width modulated signal. Yet another alternative is to coordinate the per channel output of the power supply 12 to vary the supply voltage supplied to each of the high-power amplifiers 18A-D to control the final amplitude of the radio frequency signal transmitted to the enclosed cavity 20.

As described above, the electromagnetic cooking device 10 can deliver a controlled amount of power at multiple radio frequency feeds 26A-D into the enclosed cavity 20. Further, by maintaining control of the amplitude, frequency and phase of the power delivered from each radio frequency feed 26A-D, the electromagnetic cooking device 10 can coherently control the power delivered into the enclosed cavity 20. Coherent radio frequency sources deliver power in a controlled manner to exploit the interference properties of electromagnetic waves. That is, over a defined area of space and duration of time, coherent radio frequency sources can produce stationary interference patterns such that the electric field is distributed in an additive manner. Consequently, interference patterns can add to create an electromagnetic field distribution that is greater in amplitude than any of the radio frequency sources (i.e. constructive interference) or less than any of the radio frequency sources (i.e. destructive interference).

The coordination of the radio frequency sources and characterization of the operating environment (i.e. the enclosed cavity and the contents within) can enable coherent control of the electromagnetic cooking and maximize the coupling of radio frequency power with an object in the enclosed cavity 20. Efficient transmission into the operating environment can require calibration of the radio frequency generating procedure. As described above, in an electromagnetic heating system, the power level can be controlled by many components including the voltage output from the power supply 12, the gain on stages of variable gain amplifiers including both the high-power amplifiers 18A-D and the amplitude generator 38, the tuning frequency of the frequency generator 30, etc. Other factors that affect the output power level include the age of the components, inter-component interaction and component temperature. Consequently, the function describing the output power of the overall radio frequency chain is complex, particularly in a multiple feed radio frequency system, and depends on many variables that can include variables that are not measurable. A radio frequency system to control the power output from multiple radio frequency feeds 26A-D can estimate this function by a calibration procedure and then use the calibration estimate to determine actuation settings for a desired output power level.

Calibration information to describe the output power function can be stored in a look-up table (LUT). A LUT is a data array that replaces runtime computation with a simpler array indexing operation. The LUT can include data that characterizes, per radio frequency feed 26A-D of the multiple feed radio frequency system, the gain of any of the components, an interpolation function, a baseline (or factory settings) calibration determined at the time of manufacture or assembly for the components, and an updated calibration further refined by an interpolation function, or any combination of these characteristics. In this way, the information in the LUT can identify the relationship between a control variable and the output power of the system. In other words, the LUT describes how control variables like frequency, phase, voltage from the power supply 12 and/or pulse-width modulation affect the output power at the radio frequency feeds 26A-D. Then, when in operation, the controller 14 can determine an optimal output power and invert the relationship described by the LUT to determine the settings for the control variables to achieve the desired output power.

For the output power level at the end of the amplification stage to hit a desired set-point level, the radio frequency signal generator 16 relies on feedback in the form of signals indicative of the forward and backward power levels determined by the high-power amplifiers 18A-D. Therefore, in addition to the amplifying components for outputting a radio frequency signal that is amplified in power with respect to an input radio frequency signal, the high-power amplifiers 18A-D include a measuring component that outputs a signal indicative of the radio frequency power transmitted and received by the amplifying component. The measuring component of a high-power amplifier typically includes an analog-to-digital convertor (ADC) such that the output signal is digital and readily input to a device such as the radio frequency signal generator 16. The measuring component for the high-power amplifiers 18A-D can be any component useful for the measurement of radio frequency signals including, but not limited to, radio frequency log power detectors that provide a direct current output voltage that is log-linear with respect to the detected radio frequency power level.

The proper functioning and security of an electromagnetic cooking device is directly related to the integrity of its constituent components. During production, manufacturers of electromagnetic cooking devices and their components test the compliance of their products according to specific standards. For example, the high-power amplifiers 18A-D may require some form of factory calibration such that the output signal from the measuring component can be converted into a power measurement. With a radio frequency log power detector, the output voltage can be digitized and the resulting value converted into a power level by using calibration coefficients. The calibration coefficients can be determined during a factory calibration process and stored in nonvolatile memory such as Electrically Erasable Programmable Read-Only Memory (EEPROM). During a device's lifecycle, consumers are not typically able to assess the degree of wear or possible damage of the underlying components. Consequently, a consumer could operate an electromagnetic cooking device in abnormal or fault conditions.

During operation, the forward and backward power measurements performed by the measuring component of the high-power amplifiers 18A-D strongly depend on the operating environment and conditions of the electromagnetic cooking device 10. The operating environment and conditions of the electromagnetic cooking device 10 include, but are not limited to, structural elements of the cavity 20 such as the door and the cavity walls, structural elements of the multiple radio frequency feeds 26A-D such as the waveguides, food to be cooked within the cavity 20, the placement and orientation of the structural elements and the food, etc.

By characterizing the forward and backward power measurements, the electromagnetic cooking device can form a diagnostic that can detect an abnormal or fault condition. The diagnostic can include estimating a deviation of the ratio of forward to backward power measurements with respect to an expected ratio of forward to backward power measurements. The expected ratio of forward to backward power measurements can derive from a factory calibration process where the electromagnetic cooking device was known to be operating in a replicable condition of integrity or from an in-situ calibration measurement performed when the cavity is empty.

The diagnostic can include modeling the electromagnetic cooking device 10 as a radio frequency network in a multiport configuration. A family of radio frequency network parameterizations including S-parameters, Y-parameters, H-parameters, Z-parameters, etc. can describe the electrical behavior of a multiport device such as a two-port device. S-parameters (also known as scattering parameters) characterize radio frequency networks by signal power and energy considerations and, therefore, are commonly used when direct measurements of currents or voltages are not practical. As an illustrative example, for a two port network, the S-parameters are expressed as:

$$b_1=S_{11}a_1+S_{12}a_2$$

$$b_2=S_{21}a_1+S_{22}a_2$$

With respect to the hardware components modeled by radio frequency network, the S-parameters completely characterize the radio frequency system as a function of frequency. As a diagnostic, in an empty microwave cavity, the S-parameters remain relatively stable over time where observed fluctuations occur due to aging components. The fluctuations can include any change in the measured S-parameter characterization including, but not limited to, shifts in frequency.

Figure 3:
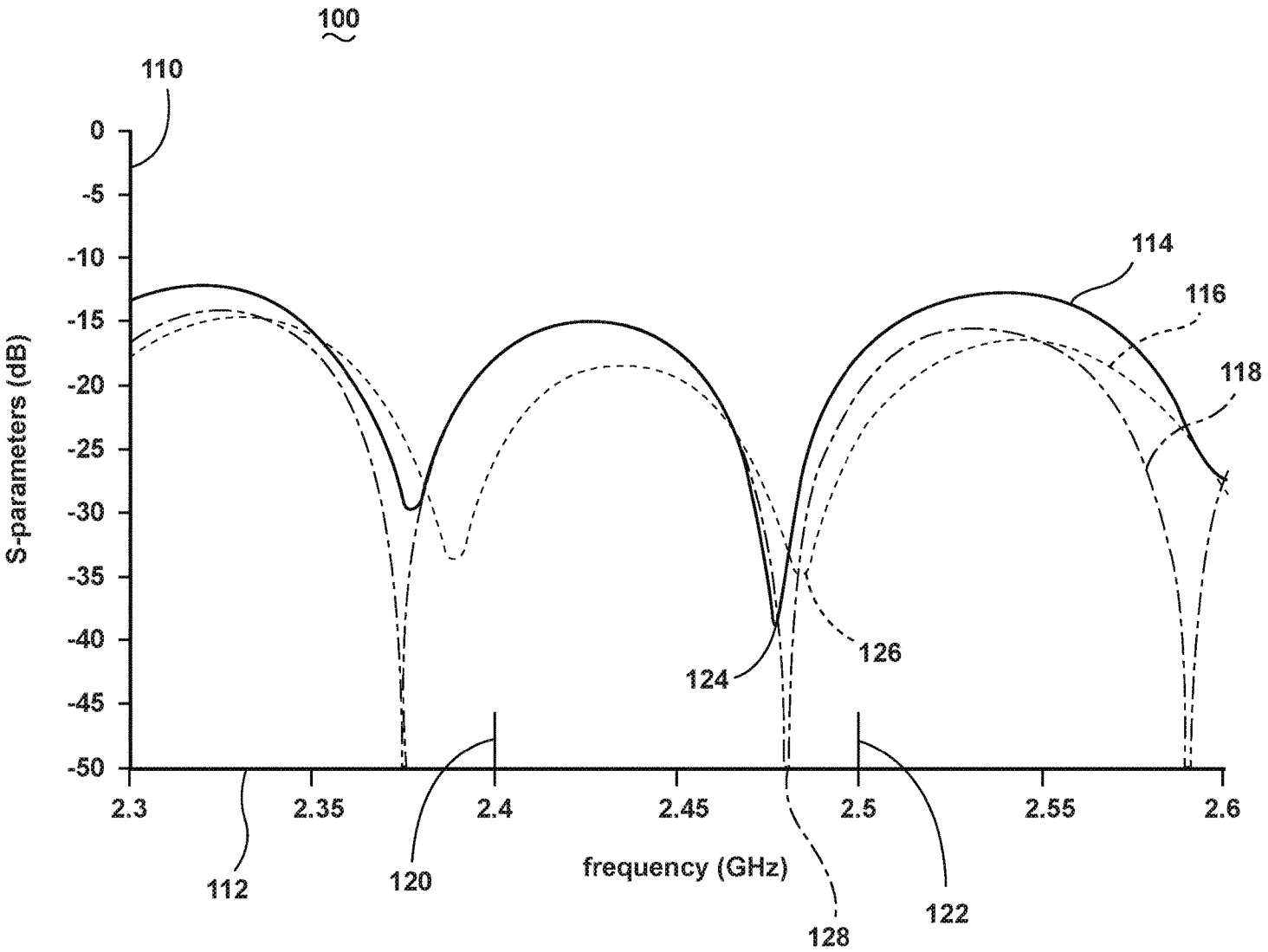
FIG. 3 is a diagram plotting an S-parameter characterization for a diagnostic of an electromagnetic cooking device in accordance with various aspects described herein.

Referring now to FIG. 3, a diagram plotting an S-parameter characterization 100 for illustrating a diagnostic of an electromagnetic cooking device in accordance with various aspects described herein is shown. The S-parameter values 110 shown in decibels are plotted against frequency 112 shown in gigahertz. The diagnostic includes storing, in memory, each S-parameter characterization as a function of frequency for an empty cavity and is plotted in FIG. 3 as 116. Periodically, the electromagnetic cooking device can measure and determine the S-parameters as is plotted in FIG. 3 as 114 and compare with the stored S-parameter characterization 116. As part of the comparison, the diagnostic can include simulating S-parameters as is plotted in FIG. 3 as 118. The comparison can include any processing suitable for determining the deviation from the stored S-parameter characterization 116 to the current S-parameter characterization 114. For example, the diagnostic can include comparing the frequency of the minimum value 124 in the current S-parameter characterization 114 to the frequency of the minimum value 126 of the stored S-parameter characterization 116. In another example, the diagnostic can include comparing the frequency of the minimum value 128 in the simulated S-parameter characterization 118 to the frequency of the minimum value 126 of the stored S-parameter characterization 116. The electromagnetic cooking device can measure across a bandwidth determined by the frequencies the high-power amplifiers can transmit. For example, the high-power amplifiers can transmit from a low frequency of 2.4 GHz 120 to a high frequency of 2.5 GHz 122.

Figure 4:
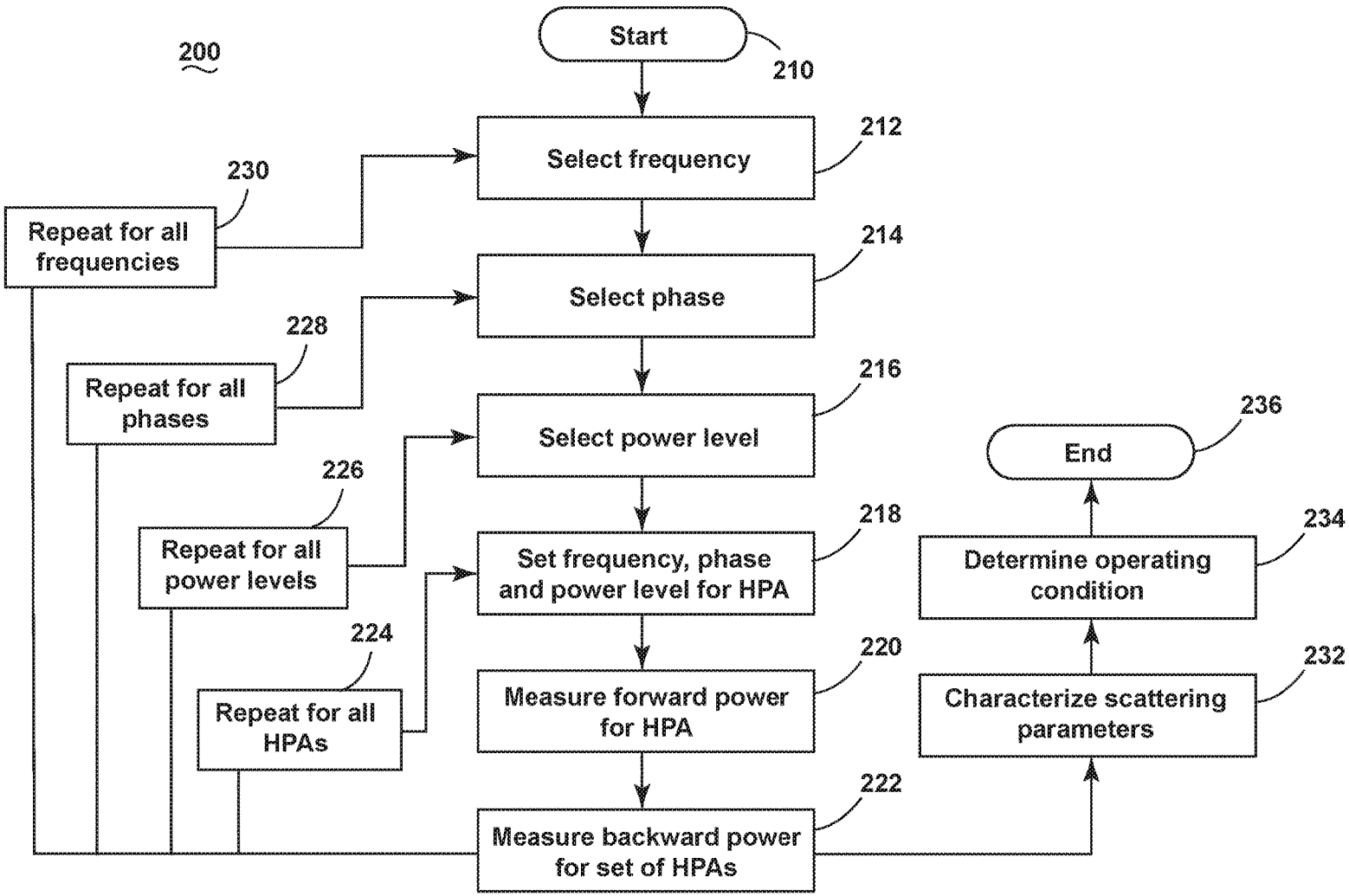
FIG. 4 is flowchart illustrating a method for performing a diagnostic for an electromagnetic cooking device in accordance with various aspects described herein.

Referring now to FIG. 4, a flowchart illustrating a method 200 for performing a diagnostic for an electromagnetic cooking device in accordance with various aspects described herein. The start of the diagnostic, at step 210, can occur during the manufacture of the electromagnetic cooking device to set an initial stored S-parameter characterization or during usage by a consumer when the cavity of the electromagnetic cooking device is empty. The diagnostic can be initiated and controlled by any component capable of processing and storing a set of S-parameter characterizations, including, but not limited to the controller 14. At step 212, a frequency is selected from a set of frequencies in a bandwidth of radio frequency electromagnetic waves. The set of frequencies can be any number of frequencies within the operable bandwidth of the high-power amplifier 18A-D. In one non-limiting example, the set of frequencies includes the ISM frequencies 2401 MHz, 2440 MHz and 2482 MHz.

At step 214, the controller 14 can optionally set a phase value that is selected from a set of phase values of radio frequency electromagnetic waves. The set of phase values can be any number of phases ranging across a wrapped phase range of −180 to 180 degrees. In one non-limiting example, the set of phases are all set to 0 degrees.

At step 216, a power level is selected from a set of power levels. The set of power levels can be any number of power levels ranging across the operable power range for the high-power amplifiers 18A-D. In one non-limiting example, the set of power levels includes three power levels: 54 dBm, 51 dBm, and 45 dBm suitable for a cooking cycle of operation. In another non-limiting example, the set of power levels includes low power suitable for performing the diagnostic but not for a cooking cycle of operation.

At step 218, one of the high-power amplifiers 18A-D is set to output a radio frequency signal of the selected frequency, the selected phase value and the selected power level. The high-power amplifier 18A-D then outputs a radio frequency signal. The measuring component internal to each of the high-power amplifiers 18A-D generates a digital signal indicative of detected radio frequency power.

At step 220, the measuring component internal to the transmitting high-power amplifier measures a forward power level. Concurrently, at step 222, the measuring component internal to a receiving set of high-power amplifiers measures a backward power for any of the high-power amplifiers, including, but not limited to, the transmitting high-power amplifier, any subset of the high-power amplifiers not currently transmitting power and combinations thereof. The measured values may be stored in the controller 14.

At step 224, the steps 218, 220 and 222 are repeated sequentially such that the set of high-power amplifiers 18A-D are sequenced to transmit and receive such that the controller can store the data necessary to perform the S-parameter characterization.

At step 226, the controller 14 can repeat steps 216, 218, 220, 222 and 224 for multiple power levels. At step 228, the controller 14 can repeat steps 214, 216, 218, 220, 222, 224 and 226 for all of the phase values in the set of phase values. At step 230, controller 14 can repeat the steps 212, 214, 216, 218, 220, 222, 224, 226 and 228 for all of the frequencies in the set of frequencies. In one non-limiting example, the controller 14 configure the high-power amplifiers 18A-D to transmit a bandwidth ranging from 2.4 GHz to 2.5 GHz at a resolution of 1 MHz allowing for 101 unique frequency selections.

At step 232, the controller 14 can process the measurements to characterize the S-parameters based on the measurements. The processing can include operations to model and fit the data, including but not limited to averaging and least-square fitting. The results of the processing can include generating and storing a set of coefficients indicative of the S-parameter characterization.

At step 234, controller 14 can determine the operating condition of the electromagnetic cooking device and take appropriate action if necessary. The controller 14 can perform the diagnostic as outlined above which includes storing, in memory, each S-parameter as a function of frequency for an empty cavity. Periodically, the controller 14 of the electromagnetic cooking device can measure and determine the S-parameters and compare with the stored values. Based on the periodic check, the diagnostic can determine an operating condition for the electromagnetic cooking device. The conditions can include at least a normal operating condition, an alert condition and a fault condition.

The controller 14 of the electromagnetic cooking device determines a normal operating condition when the stored S-parameter characterization and the current S-parameter measurement are comparable within a predetermined tolerance. The normal operating condition indicates that the electromagnetic cooking device is operating within normal parameters.

The controller 14 of the electromagnetic cooking device determines an alert operating condition when the stored S-parameter characterization and the current S-parameter measurement deviate outside the predetermined tolerance of the normal operating condition but the deviation indicates that the electromagnetic cooking device is operable. The controller 14 of the electromagnetic cooking device can implement one or more compensation techniques to maintain normal operation while detecting an alert condition.

The controller 14 of the electromagnetic cooking device determines a fault condition when the stored S-parameter characterization and the current S-parameter measurement deviate outside the predetermined tolerance of the normal operating condition and the deviation indicates that the electromagnetic cooking device is inoperable.

At step 236, the current iteration of the diagnostic is complete.

The diagnostic can provide maintenance information. For example, if one of the radio frequency feeds is damaged, the corresponding S-parameter characterization can indicate a certain condition like "short circuit" or "open circuit, and the controller can serve the information to a maintenance technician. The information can be served using any suitable transmission medium including, but not limited to, the internet, mobile communication, etc. The controller 14, by way of the diagnostic, can detect other anomalous conditions including but not limited to cavity deformation, door deformation or failure, electromagnetic leakage due to cavity damage, shorted or opened power amplifiers, waveguide damage, etc.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A method for diagnosing an electromagnetic cooking device, the electromagnetic cooking device comprising a set of radio frequency feeds, each feed comprising an amplifying component configured to output a signal that is amplified in power with respect to an input radio frequency signal and a measuring component that outputs a digital signal indicative of radio frequency power detected at the amplifying component, the method comprising:

selecting a frequency from a set of frequencies in a bandwidth of radio frequency electromagnetic waves;

setting a subset of the set of radio frequency feeds to output a radio frequency signal of the selected frequency;

measuring a forward power level for the subset of the set of radio frequency feeds that is outputting the radio frequency signal;

measuring a backward power level for the set of radio frequency feeds; and processing the measurements of the forward and backward power levels to determine an operating condition of the electromagnetic cooking device based on change of the measurements of the forward and backward power levels over time when a cavity of the electromagnetic cooking device is empty.

2. The method of claim 1 wherein processing the measurements includes modeling the electromagnetic cooking device as a radio frequency network in a multiport configuration.

3. The method of claim 2 wherein modeling the electromagnetic cooking device includes characterizing a set of radio frequency network parameters.

4. The method of claim 3 wherein the set of radio frequency network parameters includes one of S-parameters, Y-parameters, H-parameters or Z-parameters.

5. The method of claim 3 wherein determining the degree of wear or possibility of damage of underlying components includes comparing the set of parameters to a set of parameters previously stored into non-volatile memory.

6. The method of claim 1 further including transmitting the determined operating condition to a device accessible by a maintenance technician.

7. The method of claim 1 further including selecting a phase value from a set of phase values of radio frequency electromagnetic waves.

8. The method of claim 1 further including selecting a power level from a set of power levels.

9. The method of claim 1 wherein the electromagnetic cooking device includes two high-power amplifiers.

10. The method of claim 1 wherein the electromagnetic cooking device includes four high-power amplifiers.

11. The method of claim 1 wherein the set of frequencies ranges from 2.4 GHz to 2.5 GHz.

12. The method of claim 1 where the determined operating condition can indicate one of cavity deformation, door deformation, electromagnetic leakage due to cavity damage, shorted power amplifiers, opened power amplifiers or waveguide damage.

13. The method of claim 1, wherein the determined operating condition can be one of a normal operating condition, an alert condition or a fault condition.

14. The method of claim 1, wherein the processing includes calculating a deviation of the ratio of forward to backward power level measurements with respect to an expected ratio of forward to backward power level measurements.

15. An electromagnetic cooking device comprising:

an enclosed cavity;

a set of radio frequency feeds in the enclosed cavity configured to heat up and prepare food by introducing electromagnetic radiation into the enclosed cavity;

a set of high-power radio frequency amplifiers coupled to the set of radio frequency feeds, each high-power amplifier comprising an amplifying component configured to output a signal that is amplified in power with respect to an input radio frequency signal and a measuring component configured to output a digital signal indicative of radio frequency power detected at the amplifying component; and a controller configured to diagnose the electromagnetic cooking device by:

selecting a frequency from a set of frequencies in a bandwidth of radio frequency electromagnetic waves;

setting a subset of the set of high-power amplifiers to output a radio frequency signal of the selected frequency;

the controller further configured to receive from the power measuring component:

a measurement of a forward power level for the subset of the set of high-power radio frequency amplifiers that is outputting the radio frequency signal;

a measurement of a backward power level for the set of high-power radio frequency amplifiers;

wherein the controller is further configured to process the measurements of the forward and backward power levels to determine an operating condition of the electromagnetic cooking device based on change of the measurements of the forward and backward power levels over time when a cavity of the electromagnetic cooking device is empty.

16. The electromagnetic cooking device of claim 15 wherein the controller is further configured to diagnose the electromagnetic cooking device by:

selecting a phase value from a set of phase values of radio frequency electromagnetic waves; and selecting a power level from a set of power levels.

17. The electromagnetic cooking device of claim 15 wherein the controller is configured to process the measurements by modeling the electromagnetic cooking device as a radio frequency network in a multiport configuration and characterize the modeled radio frequency network with a set of radio frequency network parameters.

18. The electromagnetic cooking device of claim 17 wherein the set of radio frequency network parameters includes one of S-parameters, Y-parameters, H-parameters or Z-parameters.

19. The electromagnetic cooking device of claim 17 wherein the controller is configured to determine the operating condition by comparing the set of radio frequency network parameters to a set of radio frequency network parameters previously stored into non-volatile memory.

20. The electromagnetic cooking device of claim 15 wherein the controller is configured to determine the operating condition to be an anomalous condition indicative of one of cavity deformation, door deformation, electromagnetic leakage due to cavity damage, shorted power amplifiers, opened power amplifiers or waveguide damage.

21. The electromagnetic cooking device of claim 15, wherein the controller is configured to determine the operating condition to be one of a normal operating condition, an alert condition, and a fault condition.

22. The electromagnetic cooking device of claim 15, wherein the controller processes the measurements of the forward and backward power by calculating a deviation of the ratio of forward to backward power measurements with respect to an expected ratio of forward to backward power measurements.

* * * * *